US007938191B2

(12) United States Patent
Vaidya

(10) Patent No.: US 7,938,191 B2
(45) Date of Patent: May 10, 2011

(54) METHOD AND APPARATUS FOR CONTROLLING ELASTOMER SWELLING IN DOWNHOLE APPLICATIONS

(75) Inventor: Nitin Y. Vaidya, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 192 days.

(21) Appl. No.: 12/103,571

(22) Filed: Apr. 15, 2008

(65) Prior Publication Data

US 2008/0277109 A1 Nov. 13, 2008

Related U.S. Application Data

(60) Provisional application No. 60/917,501, filed on May 11, 2007.

(51) Int. Cl.
*E21B 33/12* (2006.01)

(52) U.S. Cl. ..... 166/387; 166/179

(58) Field of Classification Search ..... 166/179, 166/387

See application file for complete search history.

(56) References Cited

U.S. PATENT DOCUMENTS

| | | | | |
|---|---|---|---|---|
| 2,849,070 | A | 8/1958 | Maly | |
| 5,320,178 | A * | 6/1994 | Cornette | 175/19 |
| 7,304,098 | B2 | 12/2007 | Li | |
| 2005/0199401 | A1 | 9/2005 | Patel | |
| 2006/0124310 | A1 | 6/2006 | Lopez de Cardenas | |
| 2006/0185849 | A1 | 8/2006 | Edward et al. | |
| 2007/0027245 | A1 | 2/2007 | Vaidya et al. | |
| 2007/0044962 | A1 | 3/2007 | Tibbles | |
| 2007/0044963 | A1 | 3/2007 | MacDougall | |
| 2007/0051510 | A1 | 3/2007 | Veneruso | |
| 2007/0151724 | A1 | 7/2007 | Ohmer | |
| 2008/0066900 | A1 | 3/2008 | Saebi | |

FOREIGN PATENT DOCUMENTS

| | | | |
|---|---|---|---|
| EP | 1672166 | B1 | 11/2007 |
| WO | 1995006695 | A1 | 3/1995 |

* cited by examiner

*Primary Examiner* — Giovanna C Wright
(74) *Attorney, Agent, or Firm* — Rodney V. Warfford; Tim Curington

(57) ABSTRACT

A downhole tool includes a swellable core, and a coating that encapsulates the swellable core, wherein the coating is made of a material comprising a component soluble in a selected fluid and a component insoluble in the selected fluid. A method for controlling a downhole tool includes disposing a downhole tool in a wellbore, wherein the downhole tool includes a swellable core, and a coating that encapsulates the swellable core, wherein the coating is made of a material comprising a component soluble in a selected fluid and a component insoluble in the selected fluid; and exposing the swellable device to the selected fluid to increase the permeability of the coating to allow the swellable core to swell.

21 Claims, 3 Drawing Sheets

METHOD AND APPARATUS FOR CONTROLLING ELASTOMER SWELLING IN DOWNHOLE APPLICATIONS

CROSS REFERENCE TO RELATED APPLICATIONS

The present application claims priority, under 35 U.S.C. §119(e), of U.S. Provisional Application Ser. No. 60/917,501, filed on May 11, 2007, which is incorporated by reference in its entirety.

BACKGROUND OF INVENTION

1. Field of Invention

The present invention relates generally to the fields of oilfield exploration, production, and testing, and more specifically to methods and apparatus for controlling the rates of swelling of elastomeric materials that may be used as packers, seals or the like.

2. Background

Swellable polymers for use in packers have received considerable attention. U.S. Pat. No. 2,849,070, issued to George Maly in 1958, was the first patent to disclose swell packers. EP1672166A1 discloses packers having a swellable core surrounded by a coating. This patent explains that the rubber of the core can have other materials dissolved therein or may be a mixture containing fibers or cellulose. Another option disclosed in this EP patent is rubber in mechanical mixture with other polymer that expands upon contacted with oils. The coating has a higher resistance to the fluid and lower rates of diffusion for the fluid than the core. Thus, the coating disclosed in EP1672166A1 retards the rates of swelling and therefore can provide a delay in the swelling of the core, preventing the core from premature swelling. However, this same property of the coating also leads to longer times for the cores to expand and for the packers to set and seal.

To overcome some of the problems with the longer times needed to expand the packers, EP1672166A1 discloses an impermeable coating with small portions of the cores exposed. While this approach alleviates some of the problems associated with completely impermeable coatings, leaving a small region of core exposed still does not allow the unexposed regions to swell at a high rate.

U.S. application Ser. No. 11/769,207 discloses temporary containments for swellable packer elements. This application discloses methods for creating temporary containments by using sleeves made of materials that are soluble in specific activation fluids. The dissolvable protective sleeves can prevent the premature and undesired swelling of the packers. When it is desired to expand the packer, the temporary containments are dissolved (e.g., by introducing an activation fluid) to allow the swellable polymers in the cores to contact the fluids to allow the packers to expand.

In a similar approach, U.S. Patent Application Publication No. 20060185849 discloses a device which consists of a swellable elastomer core with a protective layer for fluid control. The protective layers may be removed by mechanisms, such as temperature, chemicals, radiation (magnetic transmission, electromagnetic transmission, or heat) or mechanical techniques.

Some protective layers may be removed with specific chemicals. For example, U.S. Patent Application Publication No. 20050199401 discloses devices with protective coatings that may be disintegrated by selected chemicals. These selected chemicals can be introduced into the well bore in the form of a pill or through a control line.

U.S. Patent Application Publication No. 20070027245 discloses water and oil swellable materials where the elastomers and non-elastomers may be layered, wherein individual layers may be the same or different in composition and thickness, interpenetrating networks, and the like.

Several other patents and applications also disclose swellable materials, including U.S. Pat. No. 7,059,415; WO 2005/012686, WO 2005/090741, WO 2005/090743, WO 2006/003112, WO 2006/003113, WO 2006/053896, EP 1407113, EP 283090, EP 1649136, U.S. Patent Application Publication No. 20070056735, WO 2006/063988, WO 2006/065144, WO 2006/121340, WO 2002/020941, WO 2005/116394, WO 2006/043829, and WO 2006/118470.

While these prior art technologies provide methods to delay and control the timing and rates of swellable packer expansion, there is still a need for better methods and devices for controlling the deployment and setting of swellable packers or similar devices downhole.

SUMMARY OF INVENTION

One aspect of the invention relates to downhole tools. A downhole tool in accordance with one embodiment of the invention includes a swellable core, and a coating that encapsulates the swellable core, wherein the coating is made of a material comprising a component soluble in a selected fluid and a component insoluble in the selected fluid.

Another aspect of the invention relates to methods for controlling a downhole tool. A method in accordance with one embodiment of the invention includes disposing a downhole tool in a wellbore, wherein the downhole tool that includes a swellable core, and a coating that encapsulates the swellable core, wherein the coating is made of a material comprising a component soluble in a selected fluid and a component insoluble in the selected fluid; and exposing the swellable device to the selected fluid to increase the permeability of the coating to allow the swellable core to swell.

Another aspect of the invention relates to methods for manufacturing a downhole tool. A method in accordance with one embodiment of the invention includes preparing a swellable core comprising a swellable polymer; and encapsulating the swellable core with a coating, wherein the coating is made of a material comprising a component soluble in a selected fluid and a component insoluble in the selected fluid.

Other aspects and advantages of the invention will be apparent from the following description and the appended claims.

DETAILED DESCRIPTION

Figure 1A:
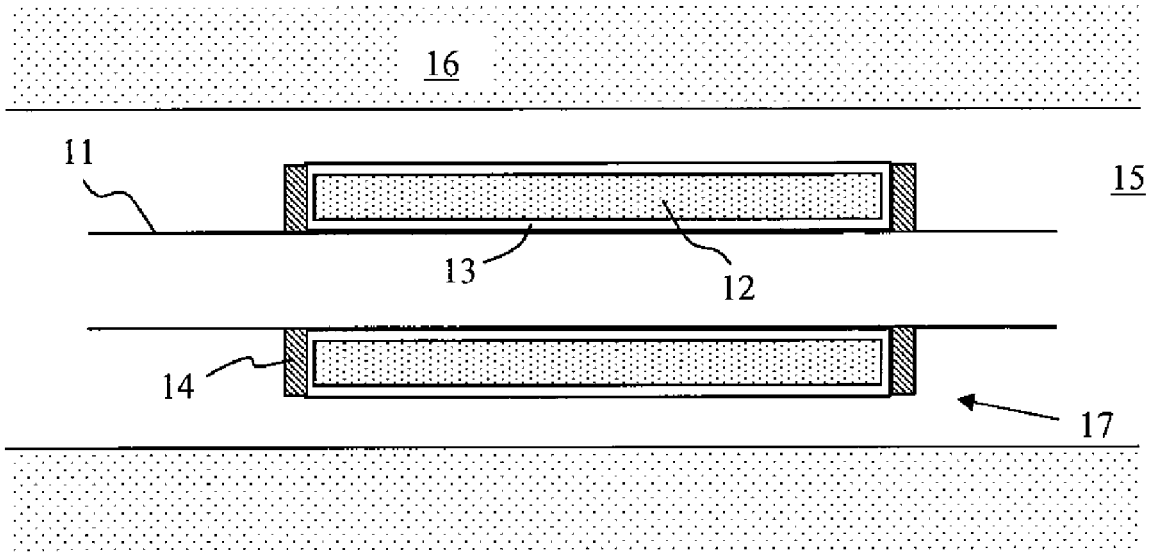
FIG. 1A shows a downhole tool having a swellable device that comprises a swellable core and a coating encapsulating the swellable core in accordance with one embodiment of the invention.

Embodiments of the invention relate to coatings that would change permeabilities after exposure to selected fluids (such as downhole fluids). Such coatings can be used with swellable polymers in various applications. For example, the permeabilities of such coatings can be made to have enhanced permeabilities upon exposure to wellbore fluids when a packer is run in hole and allowed to set. Thus, no special fluids are required to enhance the permeabilities of the coatings. This eliminates the need for fluid injection or running pills to alter the permeability of the coatings.

Using such coatings, devices and methods in accordance with embodiments of the invention can have controlled rates of swelling of elastomer materials that may be used in packers, seals, or the like in the fields of oil and gas exploration, production, and testing. For example, methods of the invention may be used to control the rates of swelling of swell packers during the run in hole and after the packers have reached the setting depths. Using coatings of the invention, swellable packers can have faster setting rates once they reach the setting depths, while at the same time they will not prematurely set during running in hole. Methods and devices of the invention are especially useful for setting swellable packers in regions of open holes, where large internal diameters may be encountered due to washouts or other phenomena.

In the following description, numerous details are set forth to provide an understanding of the present application. It will be understood by those skilled in the art that embodiments of the present invention may be practiced without some or all of these details and that numerous variations or modifications of the described embodiments may be possible without departing from the scope of the invention.

Embodiments of the invention relate to devices (such as packers, seals, or the like) that include elastomeric materials useful in oilfield applications. A typical use of devices having elastomeric components in downhole applications may include zonal isolation of wellbores. A "wellbore" may be any type of well, including, but not limited to, a producing well, a non-producing well, an injection well, a fluid disposal well, an experimental well, an exploratory well, and the like. Wellbores may be vertical, horizontal, deviated at some angle from vertical and horizontal, and combinations thereof, for example a vertical well with a non-vertical component (section).

"Elastomer" as used herein is a generic term for substances emulating natural rubber in that they may stretch under tension, may have a high tensile strength, may retract rapidly, and may substantially recover their original dimensions. The term includes natural and man-made elastomers, and the elastomer may be a thermoplastic elastomer or a non-thermoplastic elastomer. The term includes blends (physical mixtures) of elastomers, as well as copolymers, terpolymers, and multipolymers. Examples include ethylene-propylene-diene polymer (EPDM) and various nitrile rubbers that are copolymers of butadiene and acrylonitrile, such as Buna-N (also known as standard nitrile and NBR). Embodiments of swellable elastomers may include those disclosed in U.S. Application Publication No. 20070027245.

Embodiments of the invention relate to making and using devices that include swellable polymers (e.g., elastomers) with coatings that can provide a mechanism for controlling the swelling of the polymers. In accordance with some embodiments of the invention, the coatings used in these devices can change their permeabilities after exposure to downhole well fluids. Such coatings may protect the swellable polymers before it is time to swell the polymers. After such packers are run in hole, the permeabilities of the coatings would be increased due to exposure to the wellbore fluids. The increased permeabilities of the coatings would then allow the encapsulated swellable polymers to swell. Thus, no special fluids or run pills are required to expand the packers. The swelling or expanding of the swellable packers, for example, may close the annulus of the wellbore and seal it.

FIG. 1A shows an embodiment of a downhole device 17 before exposure to a solvent. The downhole device 17, for example, may be a packer wrapped around a section of a tubing 11 in a wellbore 15, penetrating a formation 16. The tubing 11 may be a pipe, wireline, cable, string, coiled tubing, or anything that runs through the wellbore 15. The downhole device 17 may be a swellable downhole packer comprising a swellable core 12 encapsulated in a coating 13. In addition, anti-extrusion rings/devices 14 may be attached to the tubing 11 at either longitudinal end of the swellable core 12 to guide the expansion of the swellable core 12 in the radial direction. The wellbore 15 may or may not include a casing.

In accordance with embodiments of the invention, the coating 13 may be made of a material comprising a soluble component and an insoluble component in a selected fluid. The selected fluid may be a downhole well fluid. Examples of the downhole well fluids include, but not limited to, hydrocarbon containing fluids, produced water, water based mud, or brine.

Figure 1C:
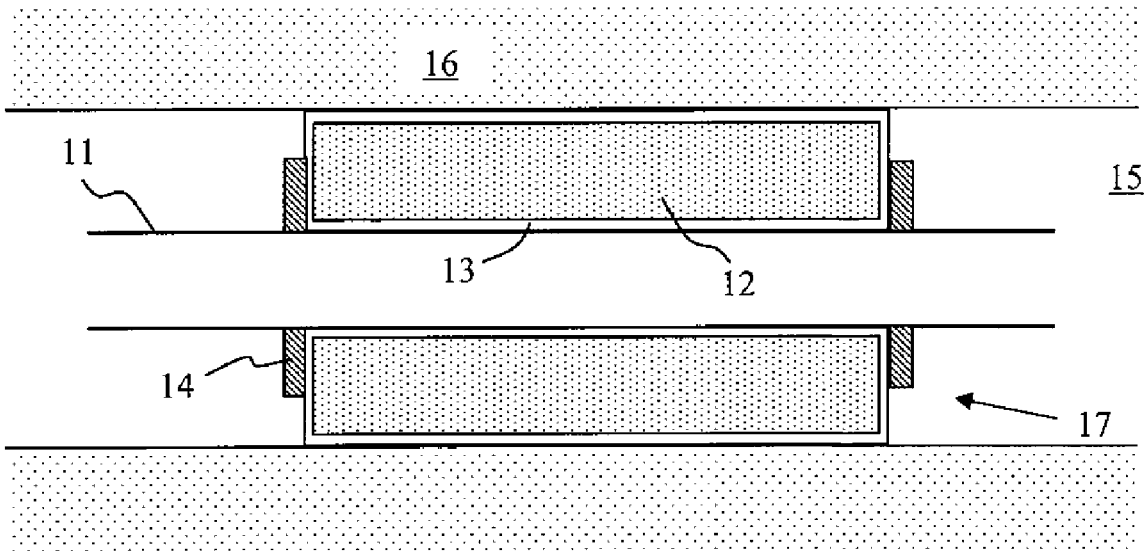
FIG. 1C shows the downhole tool of FIG. 1A after the coating becomes permeable and the swellable core has expanded in accordance with one embodiment of the invention.
Figure 1B:
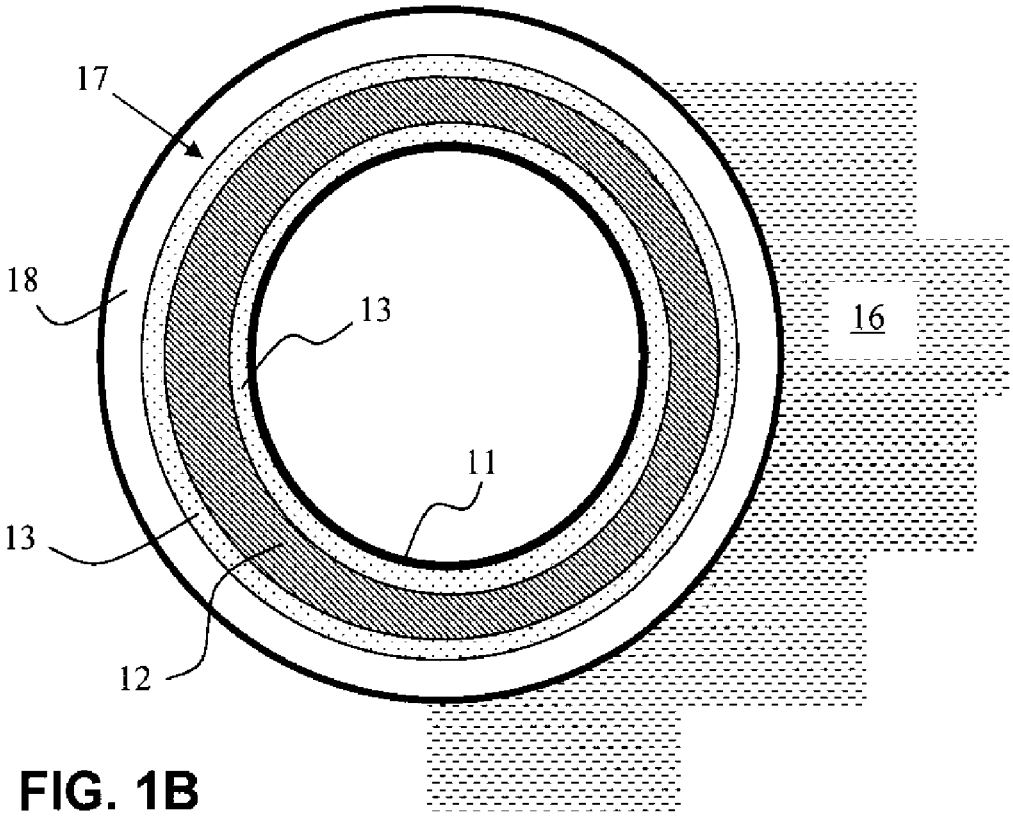
FIG. 1B shows a cross sectional view of the downhole tool of FIG. 1A.

FIG. 1B shows a cross sectional view of the embodiment shown in FIG. 1A. As shown, the downhole device 17 wraps around the tubing 11 inside the wellbore 15. The downhole device 17 contains a cylinder-shaped swellable core 12 encapsulated in the coating 13.

FIG. 1C shows an embodiment of the downhole tool 17 after exposure to a solvent (such as a downhole well fluid). As the soluble component in the coating 13 is dissolved by the solvent, the coating becomes more permeable because the remaining insoluble component may be left with interconnected channels, unconnected channels, pores, or cells. Thus, the permeability of the coating 13 would increase with time after exposure to the downhole well fluid. This would allow the downhole well fluid to diffuse through the coating 13 to contact the swellable core 12. As a result, the swellable core 12 swells and expands to cause a closure of the annulus in the wellbore 15.

As noted above, coatings in accordance with embodiments of the invention may be made of a soluble component mixed with an insoluble component, wherein the soluble component is soluble in a selected fluid. Examples of soluble components may include oil-soluble materials, while examples of insoluble components may include oil repellant (or oil-insoluble) elastomers. With such combination of oil-soluble and oil-resistant materials, the coatings may be made more permeable with an oil (a hydrophobic fluid).

Figure 2:
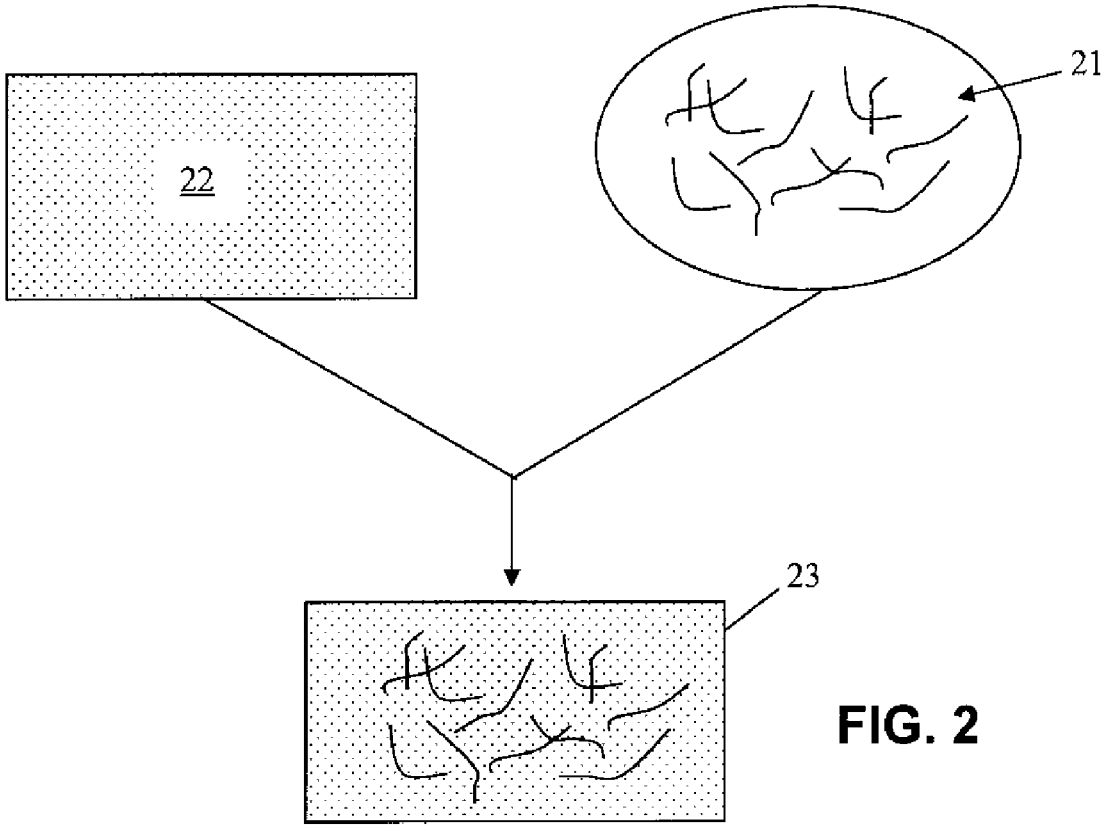
FIG. 2 shows a schematic illustrating the making of a coating material in accordance with one embodiment of the invention.

FIG. 2 shows a schematic illustrating a method for manufacturing such a coating by mixing or embedding a solvent-soluble component in a solvent-insoluble component. In one embodiment, a soluble component 21 may be mixed into an insoluble matrix material 22 to form a coating material 23 that includes the soluble component 21 embedded (incorporated) in the insoluble material (matrix) 22. The soluble components may be mixed into the matrix in any physical forms, such as polymer particles, beads or any other form of discrete or continuous filler or reinforcement. The insoluble matrix materials 22, for example, may be polymers that are oil insoluble, such as nitrile elastomers. The soluble materials (fillers or reinforcement) for downhole applications may be materials that can dissolve in the downhole well fluids such that no additional fluids or reagents are needed to make the coating permeable. For example, such soluble materials may include oil-soluble materials such as polystyrene, poly alpha methyl styrene, low molecular weight polyolefins, copolymers of styrene and acrylonitrile, poly methyl methacrylate, polycarbonate and any other polymers which may be soluble in aliphatic hydrocarbons found in produced fluids in oilfield applications. In this case, the fluids that make the coating permeable may be the same as the solvent that triggers the swelling of the elastomer core.

While the above-described embodiments use coatings that will become more permeable in hydrophobic fluids (e.g., oils), in accordance with other embodiments of the invention, the permeability of the coatings may be increased upon exposure to water or aqueous fluids. In these embodiments, the filler materials are water soluble materials, while the matrix materials are water insoluble. Examples of water soluble materials that may be used with embodiments of the invention, for example, may include polymers (e.g., polyvinyl alcohols) or salts (organic or inorganic salts).

Whether the coatings are designed to include oil-soluble or water-soluble components, the compositions or relative ratios of the soluble components and insoluble components may be adjusted to provide a control of the rates at which the coatings become more permeable. The soluble components and the insoluble components may be mixed at any desired ratios using any suitable methods known in the art. For example, loadings of soluble components may be as high as 80% w/w of the entire coating mixture. The mixture may be prepared by using any mixing equipment known in the art, such as two roller mills, blenders, or internal mixers. When the soluble components (which may be in the forms of fibers or particles) come in contact with the target fluids (e.g., hydrocarbon or water), they would be dissolved leaving behind pores, channels or cells in the crosslinked insoluble matrix (e.g., elastomer matrix of oil repellant elastomer coating compositions). As a result, the newly created channels, pores, or cells may enhance the permeability of the coating material.

Some embodiments of the invention relate to methods for controlling the rates of swelling of swellable packers during the run-in-hole operations. Specifically, use of the coatings of the invention makes it possible to prevent the swellable packers from prematurely swelling. Only after the swellable packers have reached the setting depths would the coatings contact the wellbore fluids that then trigger the dissolution of the soluble components in the coatings. Therefore, these methods may enable setting of the swellable packer without prematurely inflating the packer, while allowing the swellable packers to set with reasonable rates once they have reached the desired depth.

According to embodiments of the invention (as shown in FIG. 1), the permeability of a coating would be low until a downhole tool (such as a downhole swellable packer) is run in hole. Once the tool is placed at the desired depth (e.g., after the packer reaches the setting depth), the permeability of the coating increases due to contacts with the fluids in the wellbore. At the beginning, the permeability of the coating layer may not increase appreciably because after initial contact with the fluids, the soluble particles and fibers may need time to dissolve and leach out of the base elastomer matrix. After the initial stage, the coating may gradually become more permeable because once the initial portion of the soluble components dissolve, more channels are created in the coating layer, which in turn facilitates the dissolution and leaching out of the soluble components in the coating layer.

While the gradual increases of permeability in the coatings described above may be achieved with a single soluble component, the time-dependent increases in permeability may be further enhanced with the use of more than one soluble component. Therefore, in accordance with some embodiments of the invention, elastomer coatings with multiple soluble fillers having different solubility rates may be used. For example, rapidly dissolving salts (such as inorganic salts like sodium chloride) may be blended with slower dissolving polymers such as polyvinyl alcohol. The blend may in turn be used as dissolvable components (fillers or reinforcements) in hydrophobic elastomers to endow the coatings with different rates of increases in permeability to water or brine, thereby controlling the swelling rates of the swellable polymer cores.

In accordance with some embodiments of the invention, coatings may be made of materials that will crack when stretched beyond a threshold. The stretching may be caused by swelling of the elastomeric cores. Materials that will crack upon excessive stretching include, for example, HPC-3® coating, available from Lord Corporation (Cary, N.C.). Such materials when wrapped around elastomers that can expand to a great extent (such as ethylene propylene diene monomer rubber (EPDM), which can swell in excess of 250%) may eventually crack due to the swelling of the encapsulated elastomers.

Some embodiments of the invention relate to methods and uses of altering the permeability of a coating layer over time by exposing the swellable polymer core and the coating layer to the same fluid. The downhole well fluids, for example, may be hydrocarbon-containing fluids. The increased permeability of the coating would make more hydrocarbons available to swell the swellable polymer core. As the coating layer gradually becomes more and more permeable, the swelling of the polymer core will also occur at increasing rates. Thus, in accordance with some embodiments of the invention, the same fluid may be used to change the permeabilities of the coatings and to swell the swellable polymer cores.

As noted above, the coating layers of some embodiments of the invention may use materials comprising water-soluble components incorporated or embedded in hydrophobic (or water-insoluble) components (e.g., elastomer matrices). In these embodiments, the swellable polymer cores may be designed in such a way that they swell when come in contact with produced water, water-based mud, or brine. The water-soluble components (e.g., particles or reinforcements) may be made of materials, such as polyvinyl alcohol or calcium metal, so that the particles dissolve when they come in contact with aqueous fluids. The aqueous fluids will eventually go through the coating and swells the swellable polymer core.

In accordance with some embodiments of the invention, coatings may be applied over the swellable polymer cores in a manner such that the coatings can debond from the swellable elastomeric core. One purpose of such embodiments is to allow for faster swelling of the swellable polymer core once the fluids pass through the coating layers. Such embodiments would require shorter time to swell the polymer cores in order to seal the annulus in the wellbore.

Figure 3A:
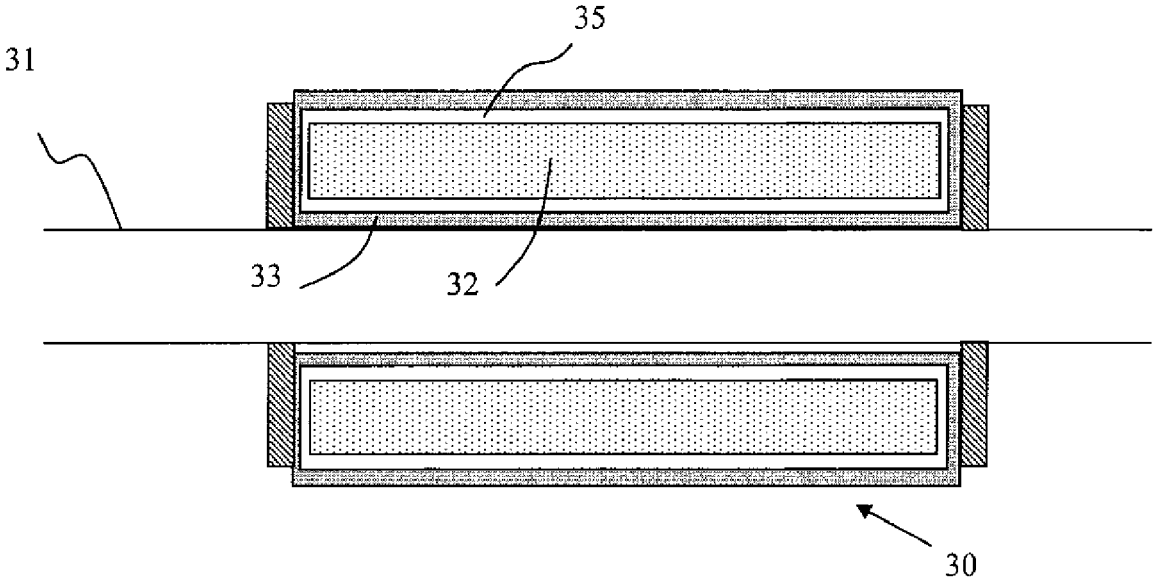
FIG. 3A shows a downhole tool having a swellable device that comprises a swellable core and a coating encapsulating the swellable core, wherein a debonding layer is disposed between the coating and the swellable core, in accordance with one embodiment of the invention.

FIG. 3A shows a diagram illustrating one such embodiment, in which a swellable packer wraps around a section of a tubing 31. The packer includes a coating 33 that is not firmly bonded to the swellable polymer core 32. In some embodiments, the interfaces between the coatings 33 and the cores 32 may include intermediary layers 35 (debonding layer) that comprise channels to conduct the fluids for swelling the swellable polymer cores 32. Alternatively, the debonding layers 35 may be made of a material that is highly permeable to the fluids for swelling the swellable polymer cores 32. In accordance with some embodiments, the debonding layers 35 may simply comprise empty space (gap) between the coatings 33 and the swellable polymer cores 32, or the debonding layers 35 may comprise materials that will dissolve in the fluids to leave behind a gap between the coatings 33 and the swellable polymer cores 32. The debonding layers 35 would allow the fluids to diffuse around the swellable polymer cores 32, creating larger contact surface areas to speed up the swelling processes. This would permit faster swelling of the swellable polymer core 32 to seal the annulus at the setting depth in the wellbore 35.

Figure 3B:
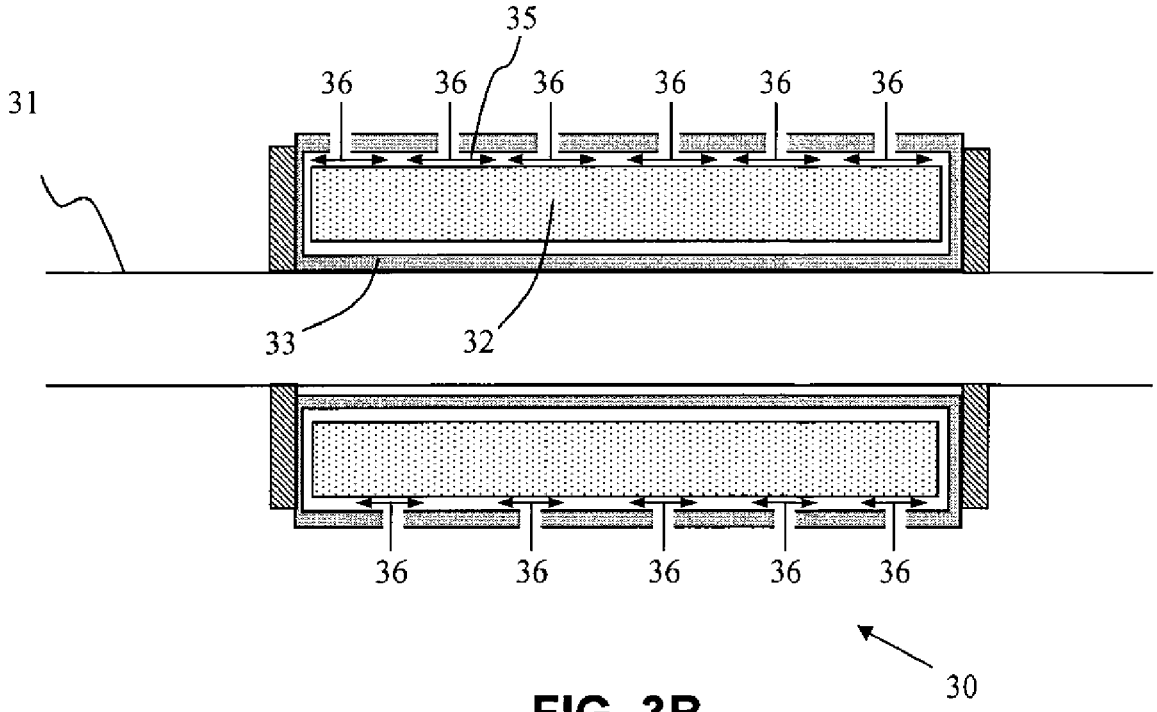
FIG. 3B shows the downhole tool of FIG. 3A after the coating has become permeable and fluids pass through the coating to spread in the debonding layer to expand the swellable core in accordance with one embodiment of the invention.

FIG. 3B shows a schematic of the embodiment shown in FIG. 3A, wherein the coating 33 has been ruptured or made permeable. As a result, fluids 36 may diffuse or permeate through the coating 33 and flow into the debonding layer 35. The fluid 36 in the debonding layer 35 can easily contact the entire surface of the swellable elastomer core 32. Thus, the debonding layer 35 makes it possible to swell the swellable polymer core 32 at faster rates.

Advantages of embodiments of the invention may include one or more of the followings. Embodiments of the invention use novel coatings to temporarily protect swellable cores such that the swellable cores will not prematurely expand. When a device of the invention reaches the target zone where the fluids in the target zone may be used to make the coatings permeable, thereby triggering the swelling processes. Embodiments of the invention may alleviate the need for special fluids to enhance the permeability of the coating and the need to inject fluid or run pills to alter the permeability of the coating. Thus, the same fluid may be used to change the permeability of the coatings and to swell the swellable polymer cores. Embodiments of the invention may allow relatively fast swelling of the swelling cores without risking premature expansion of the swellable cores. Embodiments of the invention are particularly useful in open wellbore that may have large internal diameters due to washouts and other phenomenon.

While the present description provides a limited number of embodiments, those skilled in the art, having benefit of this disclosure, will appreciate that other embodiments can be devised which do not depart from the scope as disclosed herein. Accordingly, the scope should be limited only by the attached claims.

What is claimed is:

1. A downhole tool, comprising:

a swellable core comprising a swellable polymer, and a coating that encapsulates the swellable core, wherein the coating is made of a material comprising a mixture of a component soluble in a selected fluid and a crosslinked elastomer insoluble in the selected fluid.

2. The downhole tool of claim 1, wherein the selected fluid is a downhole well fluid.

3. The downhole tool of claim 2, wherein the component soluble in the selected fluid is one or more selected from the group consisting of polystyrene, poly alpha methyl styrene, low molecular weight polyolefins, copolymers of styrene and acrylonitrile, poly methyl methacrylate, and polycarbonate.

4. The downhole tool of claim 1, wherein the selected fluid is an aqueous fluid.

5. The downhole tool of claim 4, wherein the component soluble in the selected fluid is a polyvinyl alcohol, an organic salt, an inorganic salt, or a combination thereof.

6. The downhole tool of claim 1, wherein the downhole tool is a packer.

7. The downhole tool of claim 1, wherein the downhole tool is disposed on a tubing or a string.

8. The downhole tool of claim 1, wherein the swellable polymer swells upon exposure to the selected fluid.

9. The downhole tool of claim 1, wherein the component soluble in the selected fluid comprises two different materials having different solubility properties in the selected fluid.

10. The downhole tool of claim 1, wherein the downhole tool further comprises a debonding layer between the swellable core and the coating.

11. A method for controlling a downhole tool, comprising:

disposing a downhole tool in a wellbore, wherein the downhole tool comprises:

a swellable core comprising a swellable polymer, and a coating that encapsulates the swellable core, wherein the coating is made of a material comprising a mixture of a component soluble in a selected fluid and a crosslinked elastomer insoluble in the selected fluid; and exposing the downhole tool to the selected fluid to increase a permeability of the coating to allow the swellable core to swell.

12. The method of claim 11, wherein the downhole tool is a packer.

13. The method of claim 11, wherein the component soluble in the selected fluid is oil soluble and the selected fluid is a wellbore fluid containing hydrocarbons.

14. The method of claim 13, wherein the component soluble in the selected fluid is one or more selected from the group consisting of polystyrene, poly alpha methyl styrene, low molecular weight polyolefins, copolymers of styrene and acrylonitrile, poly methyl methacrylate, and polycarbonate.

15. The method of claim 11, wherein the component soluble in the selected fluid is water-soluble and the selected fluid is an aqueous fluid.

16. The method of claim 15, wherein the water-soluble component is made of polyvinyl alcohol, an organic salt, an inorganic salt, or a combination thereof.

17. The method of claim 11, wherein the swellable polymer swells upon exposure to the selected fluid.

18. The method of claim 11, wherein the downhole tool further comprises a debonding layer between the swellable core and the coating.

19. A method for manufacturing a downhole tool, comprising:

preparing a swellable core comprising a swellable polymer; and encapsulating the swellable core with a coating, wherein the coating is made of a material comprising a mixture of a component soluble in a selected fluid and a crosslinked elastomer insoluble in the selected fluid.

20. The method of claim 19, wherein the swellable polymer swells upon exposure to the selected fluid.

21. The method of claim 19, wherein the coating is not firmly bonded on the swellable core.

* * * * *